US010273039B2

(12) United States Patent
Longberg

(10) Patent No.: US 10,273,039 B2
(45) Date of Patent: Apr. 30, 2019

(54) MERCHANDISE STORAGE CONTAINER

(71) Applicant: Wynalda Litho, Inc., Belmont, MI (US)

(72) Inventor: Daniel Paul Longberg, Rockford, MI (US)

(73) Assignee: Wynalda Litho, Inc., Belmont, MI (US)

( * ) Notice: Subject to any disclaimer, the term of this patent is extended or adjusted under 35 U.S.C. 154(b) by 118 days.

(21) Appl. No.: 15/444,513

(22) Filed: Feb. 28, 2017

(65) Prior Publication Data

US 2017/0247135 A1 Aug. 31, 2017

Related U.S. Application Data

(60) Provisional application No. 62/301,413, filed on Feb. 29, 2016.

(51) Int. Cl.

| | |
|---|---|
| ***B65D 5/38*** | (2006.01) |
| ***B65D 5/50*** | (2006.01) |
| ***B65D 5/42*** | (2006.01) |
| ***B65D 5/62*** | (2006.01) |

(52) U.S. Cl.

CPC ..... *B65D 5/38* (2013.01); *B65D 5/4208* (2013.01); *B65D 5/503* (2013.01); *B65D 5/5028* (2013.01); *B65D 5/62* (2013.01)

(58) Field of Classification Search

CPC ..... B65D 5/62; B65D 5/503; B65D 5/5028; B65D 5/4208

USPC ..... 206/756

See application file for complete search history.

(56) References Cited

U.S. PATENT DOCUMENTS

| | | | | |
|---|---|---|---|---|
| 5,088,599 | A | 2/1992 | Mahler | |
| 5,379,890 | A | 1/1995 | Mahler | |
| 5,819,928 | A | 10/1998 | Wynalda, Jr. | |
| 7,798,321 | B2 | 9/2010 | Wynalda, Jr. | |
| 7,798,322 | B2 | 9/2010 | Wynalda, Jr. | |
| 8,091,709 | B2 * | 1/2012 | Gnepper | B65D 11/12 206/37 |
| 2003/0000854 | A1 | 1/2003 | Jang | |
| 2008/0017536 | A1 | 1/2008 | Wynalda, Jr. | |

* cited by examiner

*Primary Examiner* — King M Chu

(74) *Attorney, Agent, or Firm* — Zollinger & Burleson Ltd.

(57) ABSTRACT

A merchandise storage container includes a tray slidable into and out of an outer sleeve with both formed as rigid set up boxes. The tray slides from a retracted position wherein it is disposed within and protected by an outer sleeve to an extended position with respect to an outer sleeve wherein the merchandise holder is accessible. The tray configuration provides for essentially full extension of the holder from the sleeve while preventing the tray from being readily separated from the sleeve. The merchandise holder is carried by or formed from a portion of the tray. The rear wall of the rigid set up box tray functions to lock the tray within the outer sleeve.

17 Claims, 6 Drawing Sheets

MERCHANDISE STORAGE CONTAINER

CROSS REFERENCE TO RELATED APPLICATIONS

This application claims the benefit of U.S. Provisional Patent Application Ser. No. 62/301,413 filed Feb. 29, 2016; the disclosure of which is incorporated herein by reference.

BACKGROUND OF THE INVENTION

1. Technical Field

The present disclosure relates generally to merchandise storage containers and, more particularly, to merchandise storage containers in the form of rigid set up boxes. Specifically, the disclosure relates to a merchandise storage container in the form of a rigid set up box that is adapted to store and display one or more items of merchandise with the rigid set up box adapted to slide in and out of an outer sleeve.

2. Background Information

Many retail establishments, particularly those involved with the sale of high-quality goods, employ rigid set up boxes. Rigid set up boxes are folded into an erected condition without the use of tabs or overlapping flanges adhered to the interior of other panels. The sidewalls of the box abut the other walls and an outer wrap joins and holds the corners to define a rigid, durable, non-collapsible box structure. Such boxes are formed from relatively stiff, self-supporting chipboard (0.035 to 0.125 inch chipboard is typical) combined with a wrap that covers the exterior of the box and joins and holds the corners. Lids can be provided to fit the boxes.

Various storage containers are known in the art with some using an outer sleeve and a slide-out merchandise holder. The holder receives the item or items of merchandise to be viewed by the user. The merchandise is protected by the sleeve in the retracted position and is accessible by the user when the holder is in the extended position. An issue with these types of containers is the need to maintain engagement between the holder and the sleeve so that the user does not readily separate the holder from the sleeve. Some solutions to the separation issue use folded locking flaps that result in a significant portion of the holder to remain in the sleeve when the locking flaps are engaged. Such solutions are not applicable to the construction of a rigid set up box because the folded flaps used in these solutions are not present in the rigid set up box. Other solutions use molded polymer structures to define the lock configurations.

BRIEF SUMMARY OF THE DISCLOSURE

The disclosure provides a container having an internal tray that slides into and out of an outer sleeve. At least the tray is formed as a rigid set up box. The tray slides from a retracted position wherein it is disposed within and protected by the outer sleeve to an extended position with respect to the outer sleeve. A merchandise holder can be provided with the holder being accessible when the tray is in the extended position. The tray configuration provides for essentially full extension of the holder from the sleeve. The tray and sleeve configurations prevent the tray from being readily separated from the sleeve.

The disclosure provides a container, as above, wherein the merchandise holder is carried by or formed from a portion of the tray.

The disclosure provides a container, as above, wherein the rear wall of the rigid set up box tray functions to lock the tray within the outer sleeve.

The disclosure provides a container, as above, wherein the tray is adapted to receive different types and/or configurations of merchandise holders such as vacuum-formed holders that are snap fit into or adhesively held by the tray.

The tray and sleeve can be fabricated from a paper-based material such as chipboard from 0.035 to 0.125 inches thick. An external wrap is used to assemble the tray in the manner of a rigid set up box.

In one configuration, the tray of the container includes a thin anchor wall that remains inside the sleeve when the tray is extended to prevent the tray from being readily pulled entirely from the sleeve. The thin anchor wall provides for the substantial full extension and exposure of the tray so that the entire area of the holder can be used. In order to achieve this feature, one configuration of the container uses a thin anchor wall that defines a notch that allows a portion of the tab that defines the thumb access cutout to slide through the thin anchor wall.

These configurations are provided individually and in combination with one another to form additional configurations. Examples of the invention are described below. The invention is defined by the claims.

The preceding non-limiting aspects, as well as others, are more particularly described below. A more complete understanding of the processes and equipment can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
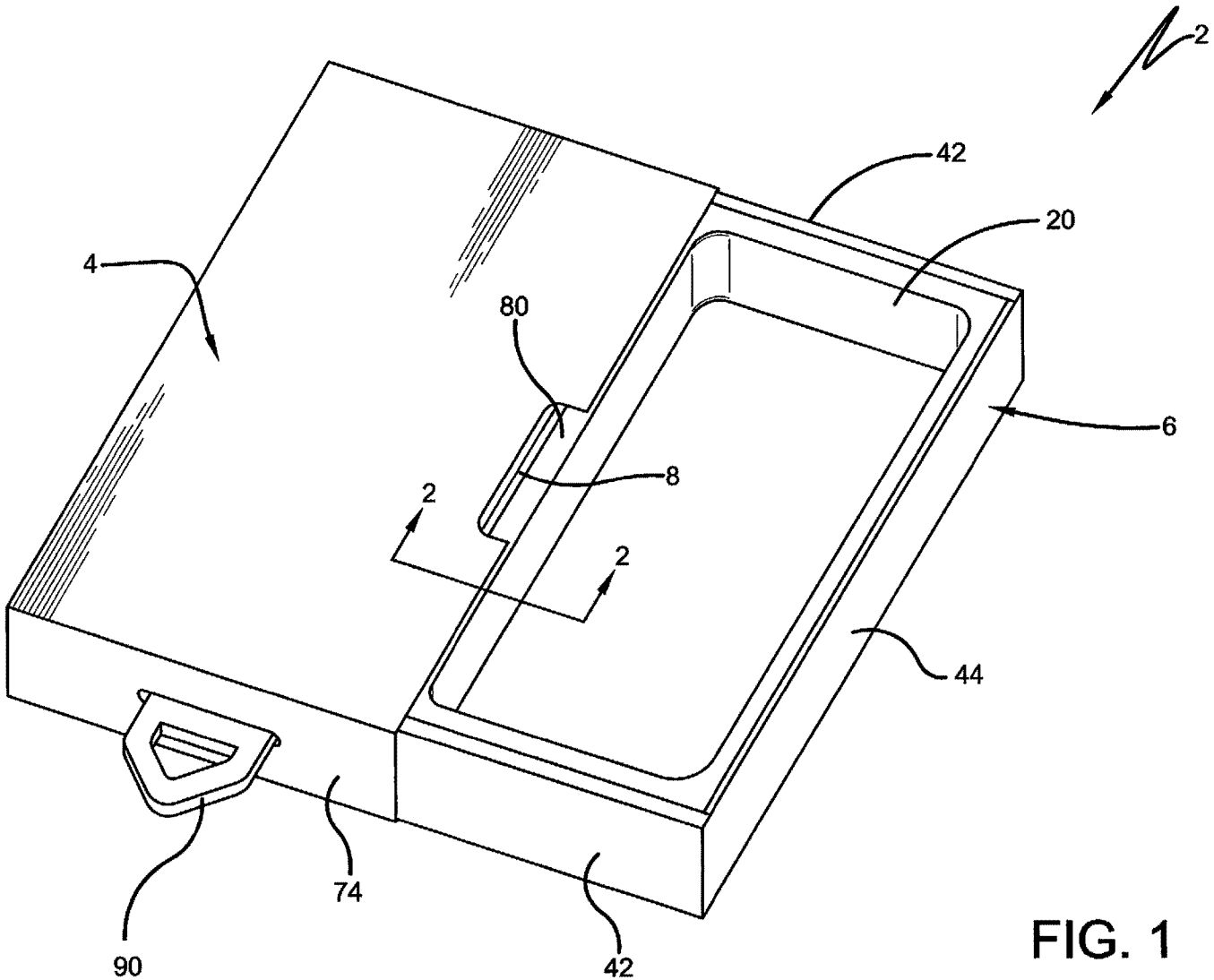
FIG. 1 is a front perspective view of a first configuration for a merchandise storage container in the extended configuration.

A first configuration of the merchandise storage container is indicated generally by the numeral 2 in the accompanying drawings. The first configuration of container 2 includes an outer sleeve 4 and a tray 6 that moves between a retracted storage condition inside tray 6 and an extended condition shown in FIG. 1. In the extended condition, a portion or portions of a rear anchor wall 8 engage a locking stop 10 carried or defined by outer sleeve 4 to stop tray 6 from being readily pulled out of outer sleeve 4 by the user. Rear anchor wall 8 is an integral structural wall of tray 6 and its configuration alone and in combination with locking stop 10 provides container 2 with desirable features. Stop 10 can be an integral portion of outer sleeve 4 or a structure that is connected to outer sleeve 4.

A merchandise holder 20 is carried by tray 6. In this configuration, merchandise holder 20 is a molded polymer holder sized to releasably hold an item of merchandise (not shown). In the exemplary configuration, merchandise holder 20 is vacuum molded and configured to hold a case for a smart phone or hand held computer. Merchandise holder 20 can be made from other materials such as injection molded polymer or paper-based materials such as paperboard. Merchandise holder 20 can be connected to tray 6 with an adhesive or, for separating the items for recycling, merchandise holder 20 can be connected to tray 6 with a plurality of protruding fingers that snap into recesses 22 defined by tray 6. Recesses 22 can be defined by the front, rear, and/or side walls of tray 6.

Figure 2:
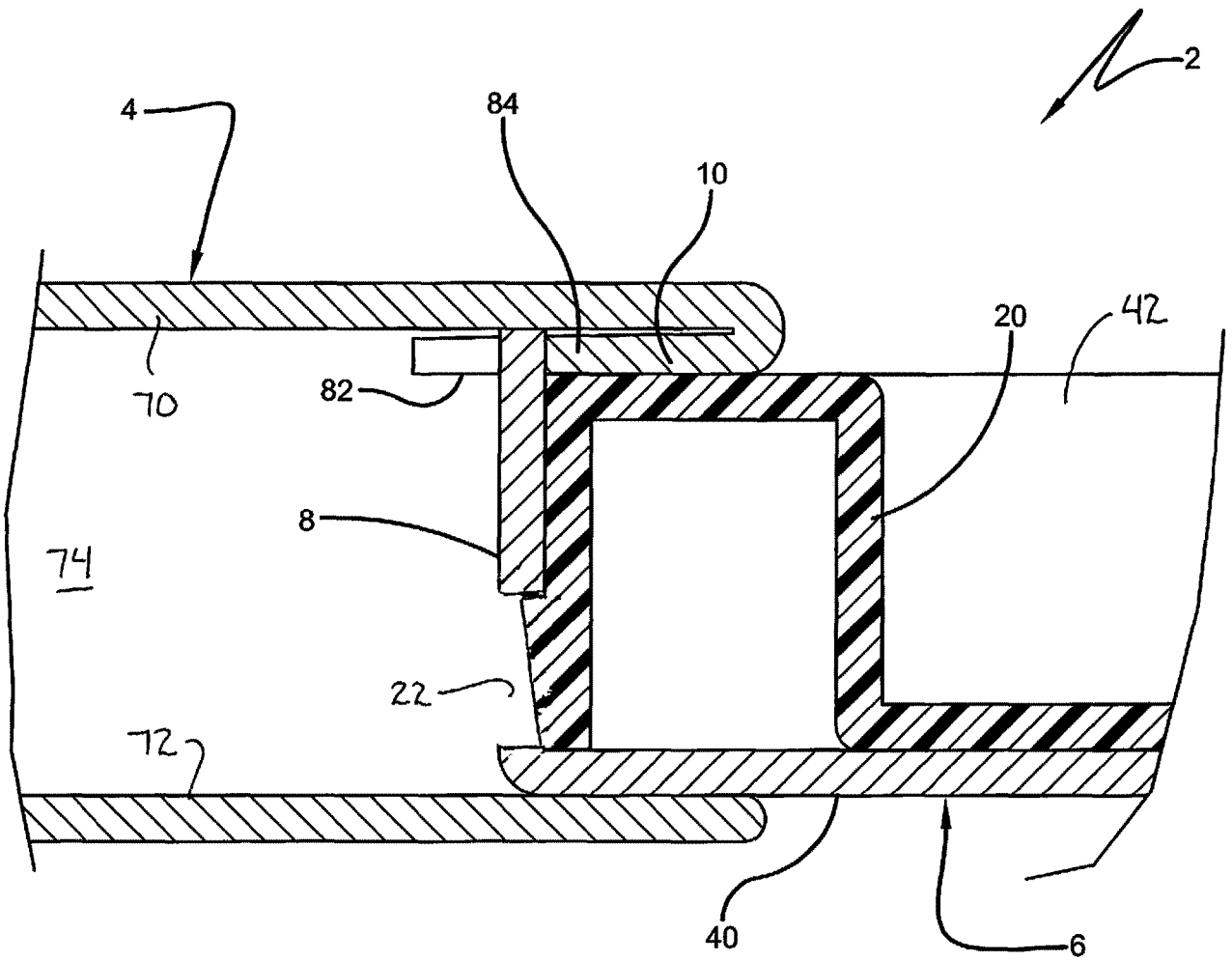
FIG. 2 is a section view taken along line 2-2 of FIG. 1 showing the engagement of the rear anchor wall with the locking tab of the sleeve and showing a portion of the locking tab of the sleeve extending through a notch defined by the anchor wall. The wrapping layers are not depicted in the cross section.
Figure 3:
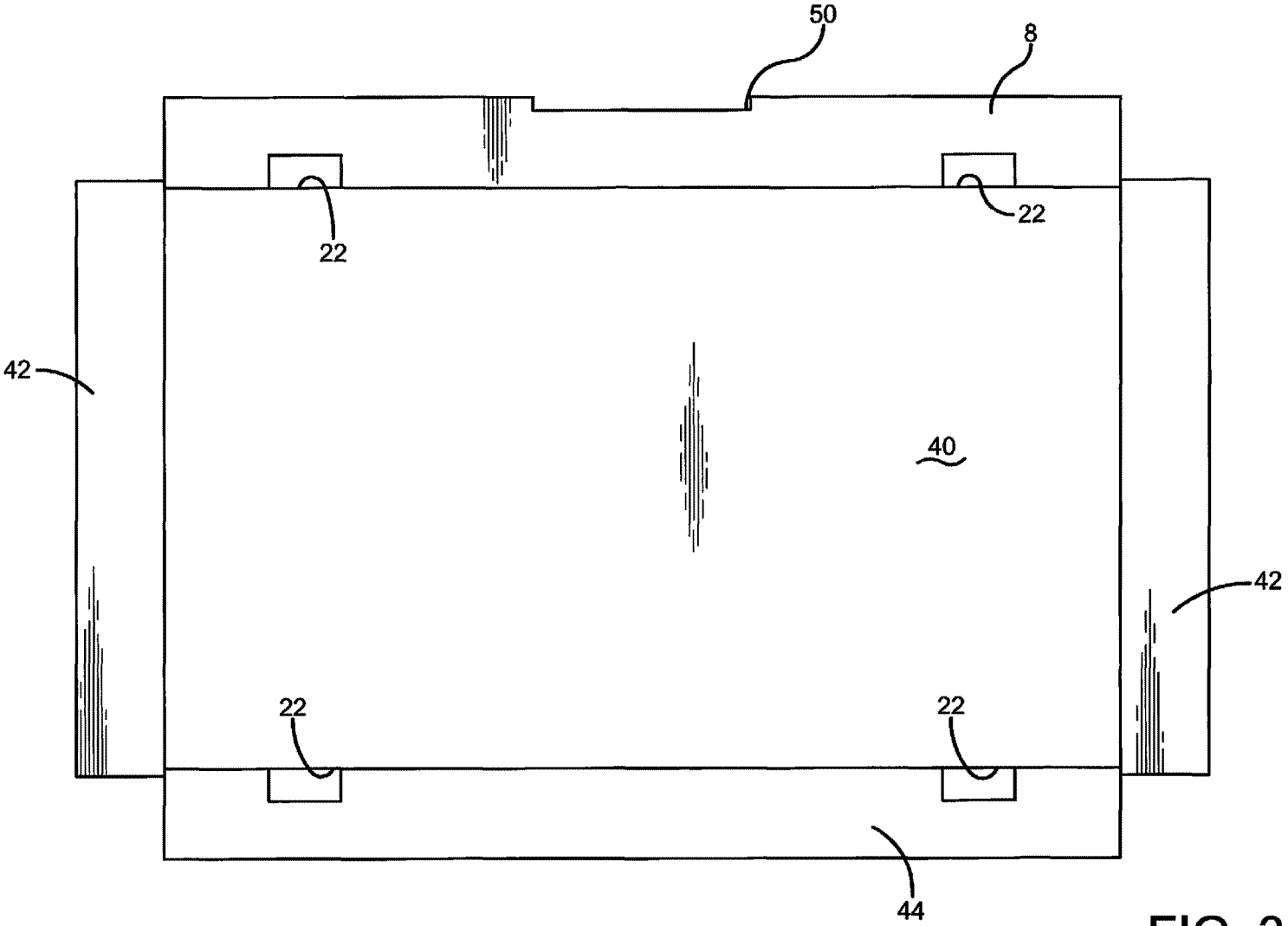
FIG. 3 is a top plan view of a blank used to create the internal structure of the tray in the form of a rigid set up box.
Figure 4:
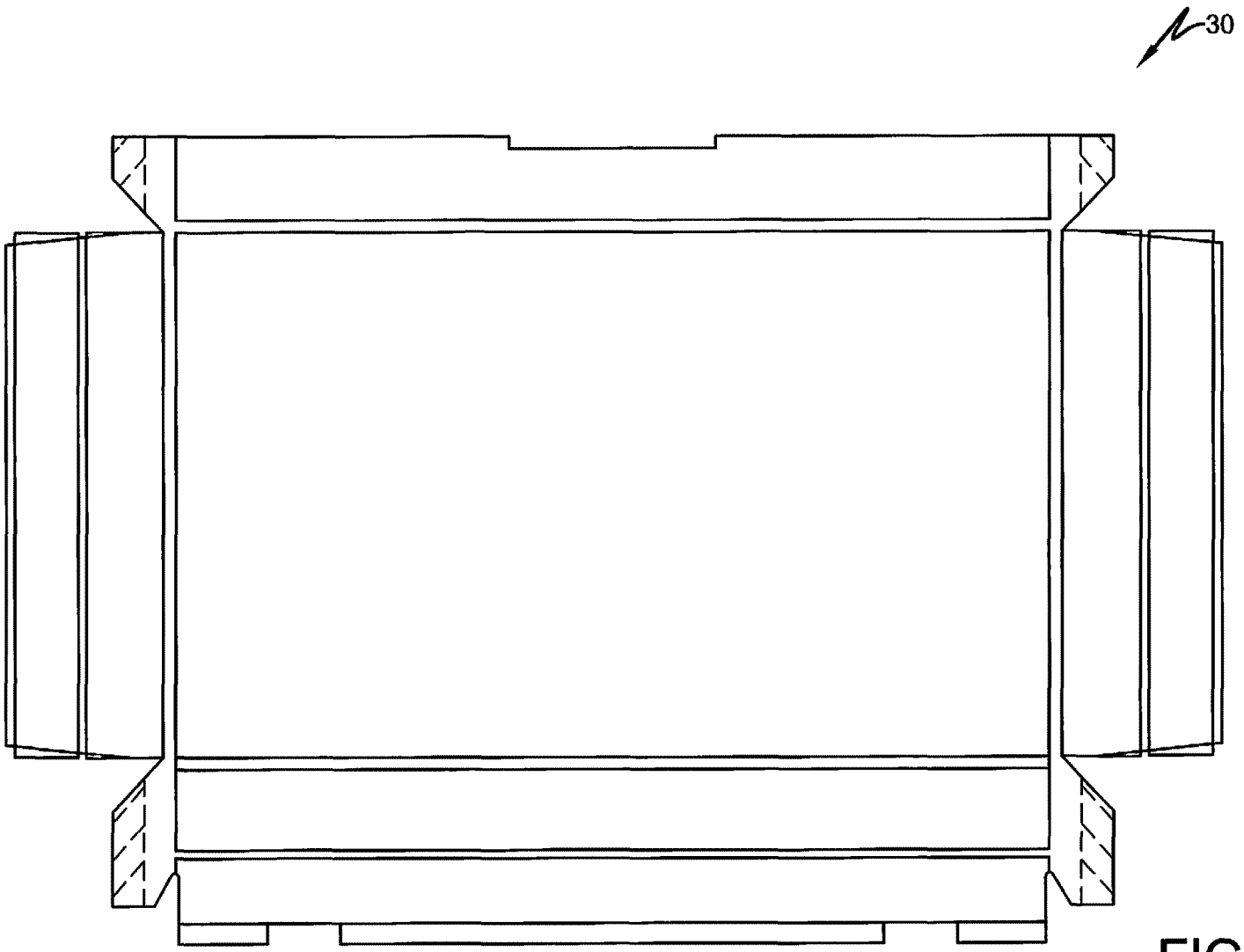
FIG. 4 is a top plan view of a blank used to create the external wrap for the tray.
Figure 5:
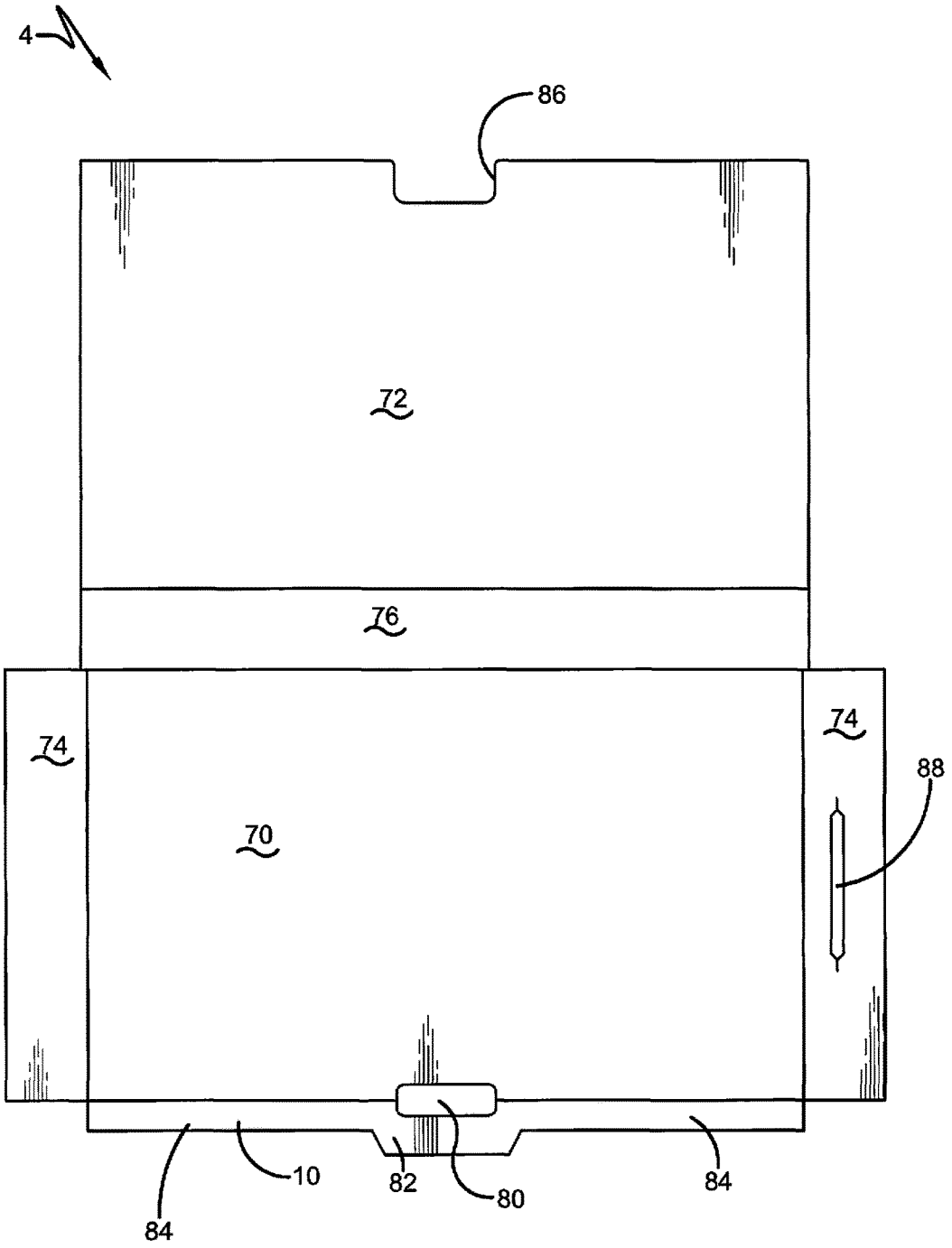
FIG. 5 is a top plan view of a blank used to create the internal structure of the sleeve in the form of a rigid set up box sleeve.
Figure 6:
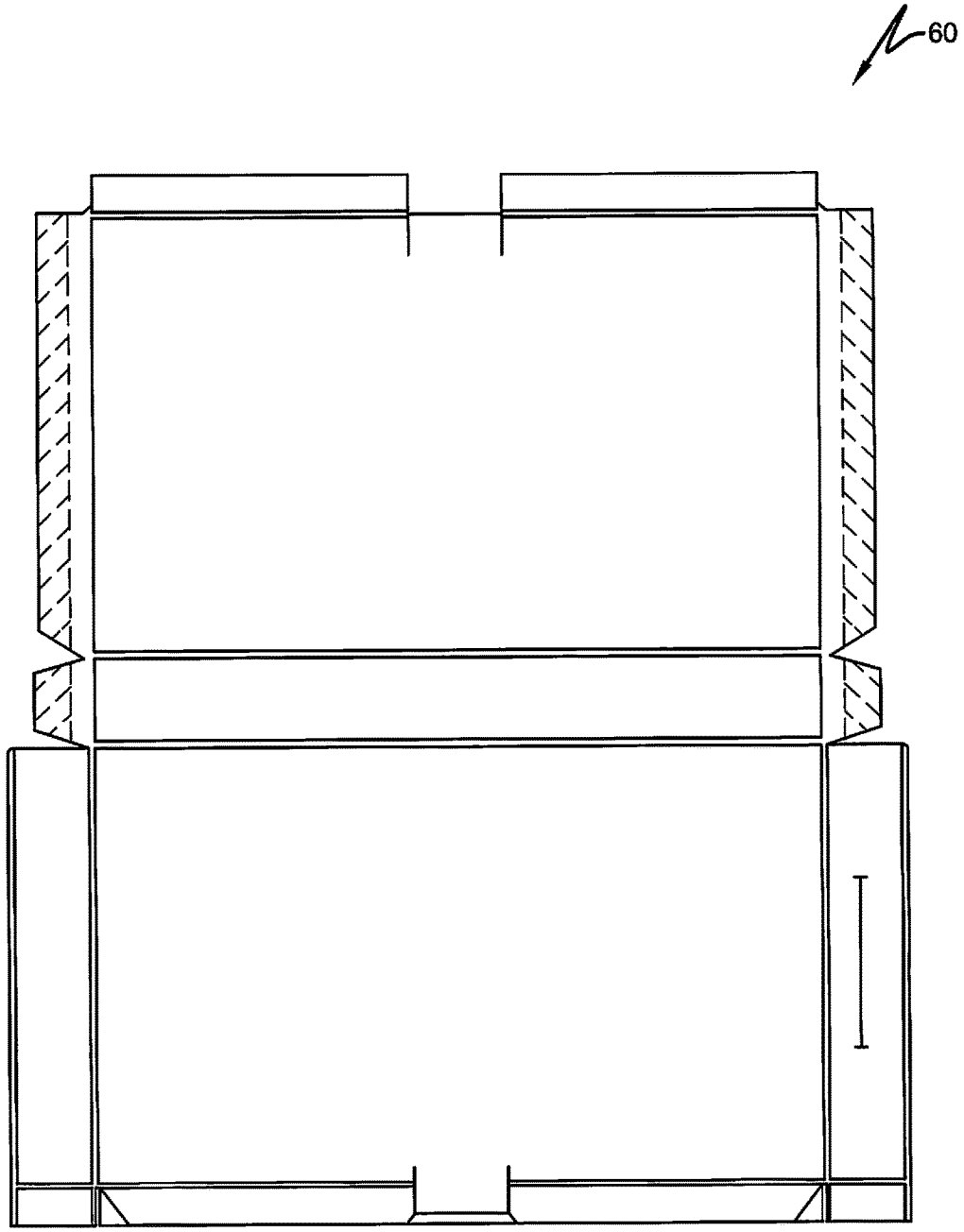
FIG. 6 is a top plan view of a blank used to create the external wrap for the sleeve.

Tray 6 is formed as a rigid set up box and is made from paperboard, chipboard, or foldable polymer material or a combination of these. A wrap 30 is adhesively connected to outside surfaces of tray 6 to hold tray 6 in its erected condition. Tray 6 generally includes a base wall 40, a pair of sidewalls 42, a front wall 44, and rear anchor wall 8. When erected, anchor wall 8 and front wall 44 abut the interior surfaces of sidewalls 42 to provide strength to tray 6. For the purpose of locking tray 6 within outer sleeve 4, rear anchor wall 8 is taller than front wall 44. In the example depicted in the drawings, rear anchor wall 8 is 0.0313 inches taller than front wall 44 and sidewalls 42. As shown in FIG. 2, rear anchor wall 8 is just about as tall as the interior height of outer sleeve 4 and it may provide frictional resistance to the movement of tray 6 with respect to outer sleeve 4. Rear anchor wall 8 defines a notch 50 that allows a portion of locking stop 10 to pass through (or over the top of) rear anchor wall 8 when tray 6 is moved to the fully extended condition. This configuration causes the tops of sidewalls 42 to slide against locking stop 10 to provide stability to container 2 because locking stop 10 can be the same width as the interior of outer sleeve 4.

Outer sleeve 4 is erected to define a five-sided box when its wrap 60 is disposed about its walls. Outer sleeve 4 generally includes a top wall 70, a bottom wall 72, a pair of end walls 74, and a back wall 76. Back wall 76 has ends that abut the interior surfaces of end walls 74 to provide structural support to outer sleeve 4. In this configuration, locking stop 10 is provided in the form of a locking flange that is pivotably connected to the front edge of top wall 70 and is folded inside outer sleeve 4 as shown in FIG. 2. The locking flange can be loosely disposed or can be adhesively connected to the inner surface of top wall 70. The locking flange can be same width as top wall 70 and the interior surfaces of end walls 74 may abut the ends of the locking flange to provide stability to outer sleeve 4.

Top wall 70 and locking stop 10 define a finger access opening 80. Locking stop 10 defines a protuberance 82 around finger access opening 80. Protuberance 82 extends through notch 50 when tray 6 is moved to the fully extended condition. This allows rear anchor wall 8 to be pulled all the way out until it engages the lateral portions 84 of locking stop 10 when tray 6 is moved to the fully extended condition. In other configurations, multiple finger access openings 80 may be provided with corresponding protuberances 82 and notches 50. Bottom wall 72 also defines a finger access opening 86 that allows the user to grip tray 6 to pull it out of outer sleeve 4.

One end wall 74 can define a slot 88 that allows a hang tab 90 to extend through end wall 74 to allow container 2 to be hung from a hook for display.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Modifications and alterations of those embodiments will be apparent to one who reads and understands this general description. The present disclosure should be construed as including all such modifications and alterations insofar as they come within the scope of the appended claims or equivalents thereof. Throughout the description and claims of this specification the words "comprise" and "include" as well as variations of those words, such as "comprises," "includes," "comprising," and "including" are not intended to exclude additives, components, integers, or steps.

The invention claimed is:

1. A merchandise storage and display container comprising:

a tray provided in the form of a set up box; the tray adapted to carry merchandise;

a five-sided outer sleeve in the form of a set up box; the outer sleeve having an opening and an interior height; the outer sleeve having a locking stop;

the tray being carried by the outer sleeve and movable between a retracted storage position and an extended condition; a majority of the tray being disposed within the outer sleeve when the tray is in the retracted storage position;

the tray having a rear anchor wall and a front wall; the height of the rear anchor wall being greater than the height of the front wall;

the front wall substantially filling the opening of the outer sleeve when the tray is in the retracted position;

the rear anchor wall engaging the locking stop when the tray is in the extended condition;

a merchandise holder carried by the tray; and the merchandise holder is connected to the tray with adhesive.

2. A merchandise storage and display container comprising:

a tray provided in the form of a set up box; the tray adapted to carry merchandise;

a five-sided outer sleeve in the form of a set up box; the outer sleeve having an opening and an interior height; the outer sleeve having a locking stop;

the tray being carried by the outer sleeve and movable between a retracted storage position and an extended condition; a majority of the tray being disposed within the outer sleeve when the tray is in the retracted storage position;

the tray having a rear anchor wall and a front wall; the height of the rear anchor wall being greater than the height of the front wall;

the front wall substantially filling the opening of the outer sleeve when the tray is in the retracted position;

the rear anchor wall engaging the locking stop when the tray is in the extended condition;

a merchandise holder carried by the tray; and the merchandise holder is connected to the tray with protruding fingers that snap into recesses defined by the tray.

3. A merchandise storage and display container comprising:

a tray provided in the form of a set up box; the tray adapted to carry merchandise;

a five-sided outer sleeve in the form of a set up box; the outer sleeve having an opening and an interior height; the outer sleeve having a locking stop;

the tray being carried by the outer sleeve and movable between a retracted storage position and an extended condition; a majority of the tray being disposed within the outer sleeve when the tray is in the retracted storage position;

the tray having a rear anchor wall and a front wall; the height of the rear anchor wall being greater than the height of the front wall;

the front wall substantially filling the opening of the outer sleeve when the tray is in the retracted position;

the rear anchor wall engaging the locking stop when the tray is in the extended condition; and the locking stop is a locking flange integrally connected to the outer sleeve with a fold; the locking flange being disposed within the outer sleeve.

4. The container of claim 3, wherein the rear anchor wall defines a notch; the outer sleeve defining a finger access opening disposed at the notch of the rear anchor wall of the tray when the tray is in the extended condition.

5. The container of claim 3, wherein the locking flange is connected to an interior of the outer sleeve with adhesive.

6. The container of claim 3, wherein the height of the rear anchor wall of the tray is substantially the same as the interior height of the outer sleeve such that the rear anchor wall of the tray frictionally slides along the interior of the outer sleeve.

7. A merchandise storage and display container comprising:

a paper-based set up tray adapted to carry merchandise;

a five-sided outer sleeve having an opening and an interior height; the outer sleeve having a locking stop;

the tray being carried by the outer sleeve and movable between a retracted storage position and an extended condition; a majority of the tray being disposed within the outer sleeve when the tray is in the retracted storage position;

the tray having a rear anchor wall and a front wall; the height of the rear anchor wall being greater than the height of the front wall;

the front wall substantially filling the opening of the outer sleeve when the tray is in the retracted position;

the rear anchor wall engaging the locking stop when the tray is in the extended condition; and the locking stop being a locking flange integrally connected to the outer sleeve with a fold; the locking flange being disposed within the interior of the outer sleeve.

8. A merchandise storage and display container comprising:

a tray adapted to carry merchandise;

a five-sided outer sleeve having an opening and an interior height; the outer sleeve having a locking stop;

the tray being carried by the outer sleeve and movable between a retracted storage position and an extended condition; a majority of the tray being disposed within the outer sleeve when the tray is in the retracted storage position;

the tray having a rear anchor wall and a front wall; the height of the rear anchor wall being greater than the height of the front wall;

the front wall substantially filling the opening of the outer sleeve when the tray is in the retracted position;

the rear anchor wall engaging the locking stop when the tray is in the extended condition;

a merchandise holder carried by the tray; and the merchandise holder is connected to the tray with adhesive.

9. A merchandise storage and display container comprising:

a tray adapted to carry merchandise;

a five-sided outer sleeve having an opening and an interior height; the outer sleeve having a locking stop;

the tray being carried by the outer sleeve and movable between a retracted storage position and an extended condition; a majority of the tray being disposed within the outer sleeve when the tray is in the retracted storage position;

the tray having a rear anchor wall and a front wall; the height of the rear anchor wall being greater than the height of the front wall;

the front wall substantially filling the opening of the outer sleeve when the tray is in the retracted position;

the rear anchor wall engaging the locking stop when the tray is in the extended condition;

a merchandise holder carried by the tray; and the merchandise holder is connected to the tray with protruding fingers that snap into recesses defined by the tray.

10. A merchandise storage and display container comprising:

a tray adapted to carry merchandise;

a five-sided outer sleeve having an opening and an interior height; the outer sleeve having a locking stop;

the tray being carried by the outer sleeve and movable between a retracted storage position and an extended condition; a majority of the tray being disposed within the outer sleeve when the tray is in the retracted storage position;

the tray having a rear anchor wall and a front wall; the height of the rear anchor wall being greater than the height of the front wall;

the front wall substantially filling the opening of the outer sleeve when the tray is in the retracted position;

the rear anchor wall engaging the locking stop when the tray is in the extended condition;

a merchandise holder carried by the tray; and the locking stop is a locking flange integrally connected to the outer sleeve with a fold; the locking flange being disposed within the outer sleeve.

11. The container of claim 10, wherein the locking flange is connected to an interior of the outer sleeve with adhesive.

12. The container of claim 10, wherein the height of the rear anchor wall of the tray is substantially the same as the interior height of the outer sleeve such that the rear anchor wall of the tray frictionally slides along the interior of the outer sleeve.

13. The container of claim 12, wherein the rear anchor wall defines a notch; the locking stop defining a protuberance disposed in the notch of the rear anchor wall of the tray when the tray is in the extended condition.

14. A merchandise storage and display container comprising:

a tray adapted to carry merchandise;

the tray having a base wall, a pair of sidewalls, a front wall, and a rear anchor wall;

a tray wrap adhesively connected to each of the base wall, the pair of sidewalls, the front wall, and the rear anchor wall to hold the tray in an erected condition;

a five-sided outer sleeve having an opening and an interior height; the outer sleeve having a locking stop;

the tray being carried by the outer sleeve and movable between a retracted storage position and an extended condition; a majority of the tray being disposed within the outer sleeve when the tray is in the retracted storage position;

the height of the rear anchor wall being greater than the height of the front wall;

the front wall substantially filling the opening of the outer sleeve when the tray is in the retracted position; and the rear anchor wall engaging the locking stop when the tray is in the extended condition.

15. The container of claim 14, wherein the locking stop is a locking flange integrally connected to the top wall of the outer sleeve with a fold; the locking flange being disposed within the outer sleeve.

16. The container of claim 15, wherein the outer sleeve has a top wall, a bottom wall, a pair of end walls, and a back wall; and a sleeve wrap adhesively connected to each of the top wall, the bottom wall, the pair of end walls, and the back wall to hold the outer sleeve in an erected condition.

17. The container of claim 16, wherein the locking flange is adhesively connected to an interior of the outer sleeve.

* * * * *